United States Patent [19]

Minamitaka

[11] Patent Number: 4,700,605

[45] Date of Patent: Oct. 20, 1987

[54] ELECTRONIC KEYBOARD MUSICAL INSTRUMENT WITH PORTAMENTO OR GLISSANDO PLAY FUNCTION

[75] Inventor: Junichi Minamitaka, Tokyo, Japan

[73] Assignee: Casio Computer Co., Ltd., Tokyo, Japan

[21] Appl. No.: 800,651

[22] Filed: Nov. 21, 1985

[30] Foreign Application Priority Data

Nov. 30, 1984 [JP] Japan ..... 59-253554

[51] Int. Cl.[4] ..... G10H 1/02; G10H 7/00

[52] U.S. Cl. ..... 84/1.24; 84/DIG. 7

[58] Field of Search ..... 84/1.1, 1.24, DIG. 7

[56] References Cited

U.S. PATENT DOCUMENTS 4,337,681 7/1982 Deutsch et al. ..... 84/1.24
4,347,772 9/1982 Nishimoto .
4,354,414 10/1982 Deutsch et al. ..... 84/1.24
4,503,745 3/1985 Clark, Jr. et al. ..... 84/1.1

FOREIGN PATENT DOCUMENTS 1497785 6/1969 Fed. Rep. of Germany .
3318668 8/1984 Fed. Rep. of Germany .
2129997 5/1984 United Kingdom .

*Primary Examiner*—Stanley J. Witkowski
*Attorney, Agent, or Firm*—Frishauf, Holtz, Goodman & Woodward

[57] ABSTRACT

In an electronic keyboard musical instrument with a portamento or glissando play function, a touch response detector is arranged to detect a key touch response such as a depression speed or pressure of a key depressed on a keyboard. A musical tone generating device with a portamento or glissando play function is arranged to change a portamento or glissando time in response to the touch response of the depressed key.

16 Claims, 14 Drawing Figures

FIG. 2

| NOTE | DECIMAL | HEXA DECIMAL |
|---|---|---|
| C1 | 0 | 0 |
| C1# | 1 | 1 |
| D1 | 2 | 2 |
| D1 | 3 | 3 |
| D1 | 4 | 4 |
| F1 | 5 | 5 |
| F1# | 6 | 6 |
| G1 | 7 | 7 |
| G1# | 8 | 8 |
| A1 | 9 | 9 |
| A1# | 10 | 1A |
| B1 | 11 | 1B |
| C2 | 12 | 1C |
| C2# | 13 | 1D |
| | | |
| | | |
| C5 | 48 | 30 |
| C5# | 49 | 31 |
| D5 | 50 | 32 |
| D5# | 51 | 33 |
| E5 | 52 | 34 |
| F5 | 53 | 35 |
| F5# | 54 | 36 |
| G5 | 55 | 37 |
| G6# | 56 | 38 |
| A5 | 57 | 39 |
| A5# | 58 | 3A |
| B5 | 59 | 3B |
| C5 | 60 | 3C |

ELECTRONIC KEYBOARD MUSICAL INSTRUMENT WITH PORTAMENTO OR GLISSANDO PLAY FUNCTION

BACKGROUND OF THE INVENTION

The present invention relates to an electronic keyboard musical instrument with a portamento or glissando play function.

In a conventional electronic musical instrument of this type, a player presets a portamento play time or the like by an external device such as a potentiometer. In this sense, the preset portamento time remains unchanged unless the external device is operated.

Another conventional electronic musical instrument with a key depression speed or pressure detection function, i.e., a so-called touch response function has been commercially available. The key depression speed or pressure (to be referred to as a touch response hereinafter) is not associated with the portamento time at all. In other words, the portamento time is predetermined while the touch response play is being performed, resulting in poor musical expressions.

SUMMARY OF THE INVENTION

It is an object of the present invention to provide a new and improved electronic keyboard musical instrument having an improved musical performance effect.

It is another object of the present invention to provide a new and improved electronic keyboard musical instrument wherein an effective time or speed of portamento or glissando play can be changed in response to a touch response of the key depression on a keyboard.

In order to achieve the above objects of the present invention, there is provided an electronic keyboard musical instrument with a portamento or glissando play function, comprising means for detecting a touch response such as a depression speed or depression pressure of a key depressed on a keyboard, and means for changing a time (or speed) of a portamento or glissando effect in accordance with a detection result from the detecting means.

BRIEF DESCRIPTION OF THE DRAWINGS

FIG. 2 is a table showing key codes in the instrument of FIG. 1;

DETAILED DESCRIPTION OF THE PREFERRED EMBODIMENTS

Figure 1:
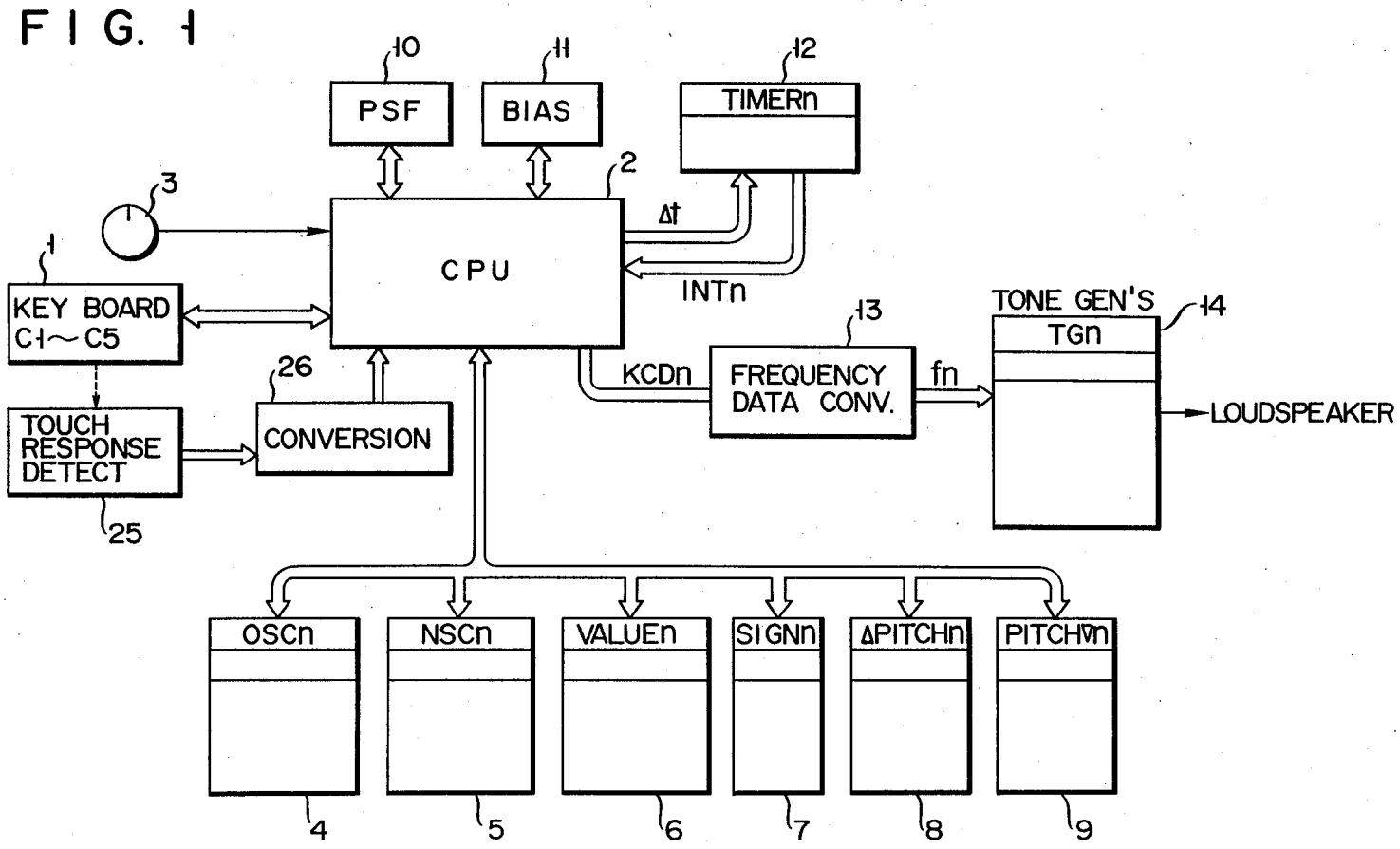
FIG. 1 is a block diagram of an electronic keyboard musical instrument with a portamento or glissando play function according to a first embodiment of the present invention.

An electronic keyboard musical instrument with a portamento or glissando play function according to an embodiment of the present invention will be described with reference to the accompanying drawings. Reference numeral 1 denotes a keyboard with, for example, 61 keys corresponding to notes from note C1 to note C6. Key operation signals from keyboard 1 are supplied to a central processor unit (CPU) 2. CPU 2 comprises a microprocessor for performing various operations to be described later. CPU 2 is coupled to a potentiometer 3 for changing a portamento (glissando) time, i.e., a portamento (glissando) speed. CPU 2 further receives a touch response detection output signal from a converter 26 which converts an output signal of a touch response detector 25 for detecting a speed of a depressed key to a corresponding digital output signal. CPU 2 generates and supplies various data to registers 4 to 11 in accordance with output signals of keyboard 1, potentiometer 3 and converter 26 and performs operational processings in accordance with contents of registers 4 to 11.

Register 4 stores a key code representing a immediately preceding depressed key. Register 4 has areas (e.g., eight areas n=0 to 7) corresponding to the number of keys which are simultaneously depressed to produce polyphonic tones. The code of the immediately preceding depressed key is given as OSC (Sold Scale Code) in FIG. 1.

Register 5 stores a key code representing a currently depressed key. In the same manner as in register 4, register 5 has eight key code areas n (=0 to 7). The code of the currently depressed key is represented by NSC (New Scale Code) in FIG. 1.

As shown in FIG. 2, each key has a key code represented by a binary code. The key codes are given by 0 to 3C in hexadecimal notation.

Register 6 stores a differential code obtained by subtracting the key code NSC from the key code OSC. Register 6 similarly has eight areas n (=0 to 7). The differential code (OSC−NSC) is represented by VALUE in FIG. 1. Register 7 stores a sign (i.e., the positive or negative sign) of (OSC−NSC). Register 7 has eight code areas n (=0 to 7) in the same manner as the previous registers. The sign of (OSC−NSC) is represented by SIGN in FIG. 1.

Register 8 stores a small code which is represented by ΔPITCH in FIG. 1 and obtained by a following arithmetic operation:

$$\Delta PITCH = |OSC - NSC| \times PSF/BIAS$$

where PSF is a portamento speed factor stored in register 10 which determines the portamento speed or time and varies in accordance with output values of converter 26 and potentiometer 3, and BIAS is a constant which determines a frequency resolution, or a minimum step size for interval variation of less than a semitone (100 cents) and which is stored in register 11. In this embodiment, the PSF is given in a range of 1 to 3F (hexadecimal notation), and the BIAS is given by $2^{10}$ (=1024). It should be noted that register 8 also has eight areas n (=0 to 7).

The small codes ΔPITCH are accumulated at a time interval of 8 msec and stored in register 9. Register 9 has eight areas n (=0 to 7). The accumulated code is represented by PITCH∇ in FIG. 1.

A timer 12 is provided which has eight timer units represented by TIMERn (n=0 to 7) in FIG. 1. Operation time data Δt (=8 msec) from CPU 2 is preset in timer 12. When the preset time has elapsed, timer 12 supplies an interrupt signal INT to CPU 2.

CPU 2 generates key code signals KCD each of which sequentially varies at an interval of ΔPITCH in response to output signals of registers 4 to 11 and timer 12 during a portamento mode. The number of key code signals KCD generated by CPU 2 is the same as that of tones (at most 8) which may be simultaneously played. Signals KCD are supplied to a frequency data converter 13. Signal KCD represents a code in proportion to cents. Converter 13 is responsive to key code signals from CPU 2 to drive tone generators 14 which are operated in units of hertz. Frequency designation data output from converter 13 is represented by fn in FIG. 1.

Tone generators 14 have tone generating circuits which are equal, in number, to the maximum number of tones (n=0 to 7) in polyphonic performance. Tone generators 14 may be constituted by separate circuit arrangements or a single circuit arrangement to produce tone signals on a time division basis.

Figure 3A:
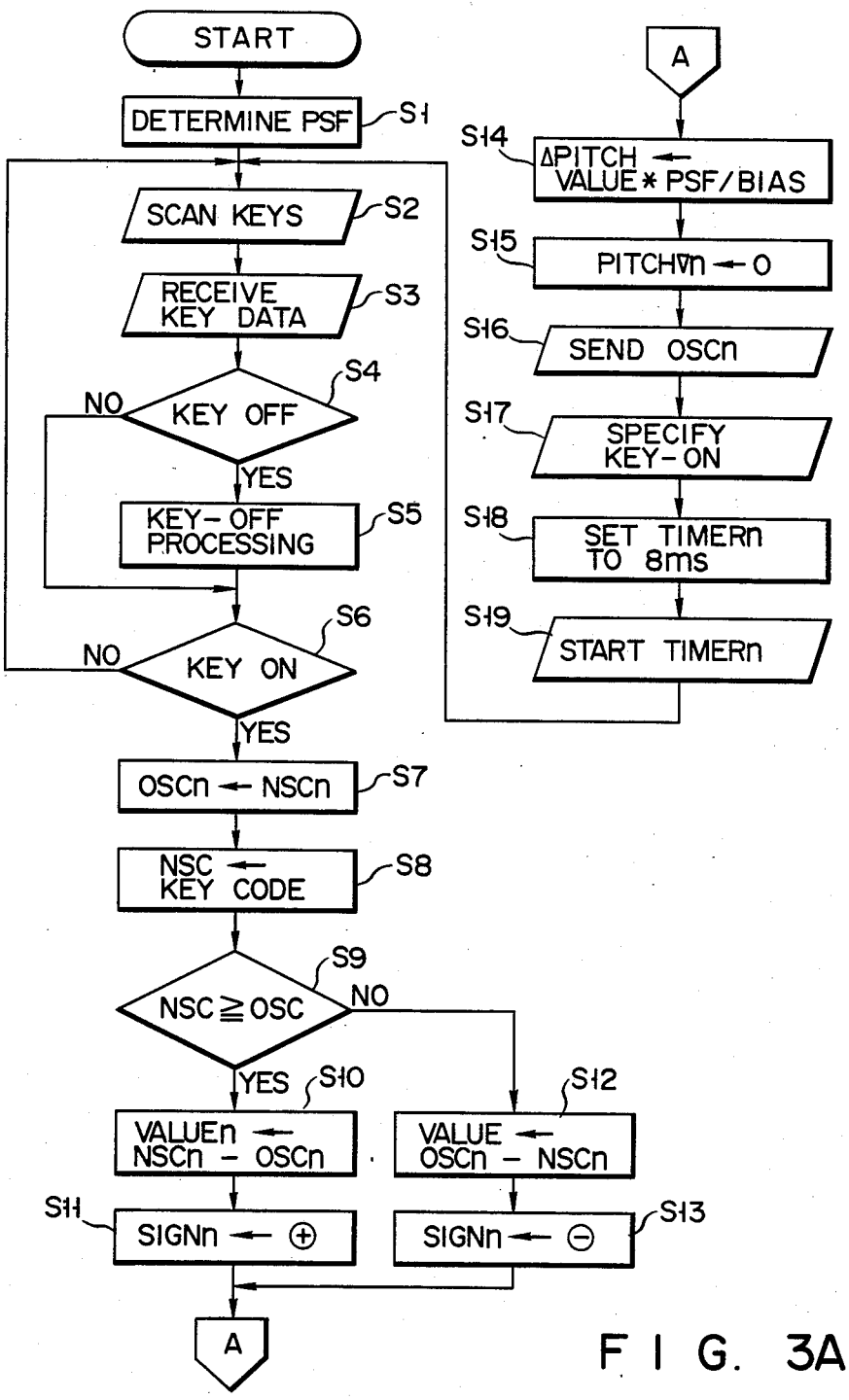
FIGS. 3A and 3B are a flow chart for explaining the operation of the instrument of FIG. 1.
Figure 3B:
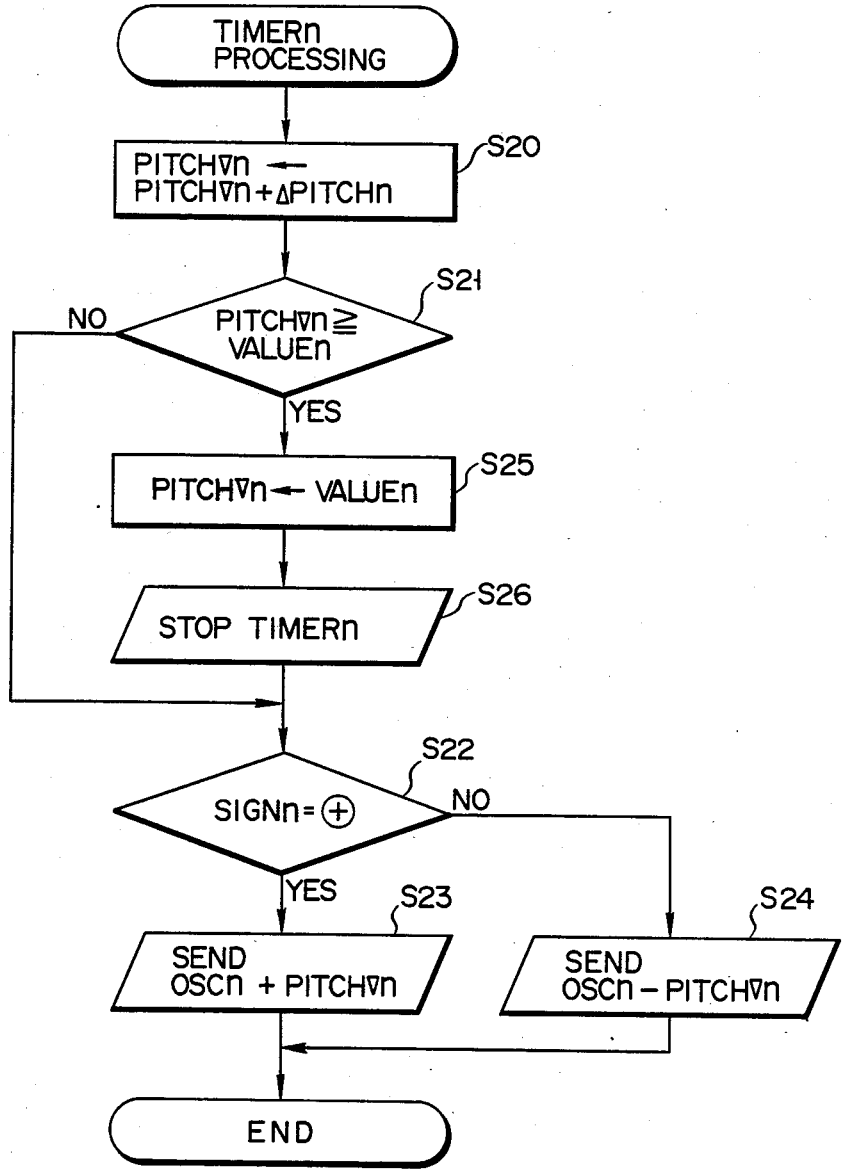

The operation of the electronic keyboard musical instrument as described above will be described with reference to FIGS. 3A to 7. FIGS. 3A and 3B are flow charts for explaining the operation of CPU 2. In step S1 of FIG. 3A, CPU 2 determines a PSF value in register 10. The PSF value varies upon operation of potentiometer 3 by a player before musical performance. However, the PSF value can be changed from touch response data from converter 26 during a musical performance. The slowest portamento is achieved for a PSF value of 1 and, the fastest portamento is achieved for a PSF value of 3F (hexadecimal notation). It should be noted that potentiometer 3 is provided for reducing unnaturalness in portamento effect caused by a touch response difference observed between players. Therefore, a substantially identical portamento effect can be achieved for adult and child players.

In steps S2 and S3 (FIG. 3A), CPU 2 supplies key scanning signals to keyboard 1 and receives key data signals in response thereto, thereby detecting operating states of keyboard 1. The operation advances to step S4. If a newly released key is present, CPU 2 performs key-off processing in step S5. More specifically, CPU 2 supplies a key-off instruction to a specific tone generator TGn in tone generators 14 through a signal line (not shown) so as to stop a musical tone being produced by tone generator TGn.

If NO in step S4, the operation advances to step S6 instead of step S5. Note that the operation advances to step S6 after step S5 is completed.

As a result of steps S2 and S3, CPU 2 checks in step S6 whether or not a newly depressed key is present. If NO in step S6, step S2 is done. However, if YES in step S6, step S7 is done. In step S7, CPU 2 transfers a code NSCn which has been stored in register 5 to register 4 as a code OSCn. The operation advances to step S8 in which CPU 2 stores the key code corresponding to the newly depressed key in register 5 as a code NSC.

In this embodiment, key codes are assigned to the eight storage areas of each register in the increasing order of n. Assume that one key is depressed and released, and then another key is depressed. In this case, the two key codes are sequentially assigned to the n=0 register. When three keys are simultaneously depressed, the key codes are assigned to the n=0 to 2 registers, respectively. After the said three keys have been released, when other three keys are depressed, the corresponding key codes are assigned to the identical registers (n=0 to 2).

In step S9, CPU 2 compares, in magnitude, the content NSCn in register 5 with the content OSCn in register 4. When NSCn≧OSCn, the operation advances to step S10. The value (NSCn−OSCn) is stored as VALUEn in register 6. In step S11, data representing the positive sign ⊕ is stored as SIGNn in register 7.

In this case, since the new key code NSCn is larger than the old key code OSCn, a portamento effect with a rising tone pitch is obtained.

However, if NSCn<OSCn in step S9, the operation advances from step S9 to step S12. In step S12, the value (OSCn−NSCn) is stored as VALUEn in register 6. In step S13, data representing the negative sign ⊖ is stored as data SIGNn in register 7. Since the NSCn is smaller than the OSCn, a portamento effect with a falling tone pitch is achieved.

After operation in step S11 or S13, the operation advances to step S14 shown in FIG. 3B. In step S14, CPU 2 determines a unit of pitch variation width represented by the small code ΔPITCHn (in units of cents) for portamento effect. The pitch variation unit ΔPITCHn can be calculated in accordance with using the VALUEn in register 6, the PSF in register 10 and the BIAS in register 11 as follows:

$$\Delta PITCHn = |OSCn - NSCn| \times PSC \times BIAS$$

The calculated value is stored in register 8.

When the PSF is 1 (i.e., key depression speed is slowest), the OSC is 0 and the NSC is 1, the value ΔPITCH is $$\Delta PITCH = |0 - 1| \times 1/1024$$
$$= 9.765625 \times 10^{-4} \text{ cents}$$

The ΔPITCH is expressed in binary notation as follows:

000000.0000000001

The bits positioned on the left hand side of the binary point represent pitch difference exceeding the semitone (i.e., 100 cents), and lower bits on the right hand side of the binary point represent pitch difference less than the semitone.

As will be described later, since the number of times of accumulation of ΔPITCH is $|0-1|/9.765625\times10^{-4}=1024$ and one operation cycle is Δt=8 msec, the portamento time is about 8.2 sec (8 msec×1024). This indicates that about 8.2 sec are required to change the pitch from a tone pitch of OSC=0 to that of NSC=1 at a pitch interval of 1/1024 cents (i.e., the minimum pitch interval change width).

Similarly, when key depression speed is slowest and an OSC is 0 and an NSC is 3C $$\Delta PITCH = |0 - 3C| \times 1/1024$$
$$= 0.05859375$$

This is represented in binary notation as follows:

000000.0000111100

In this case, the number of times of accumulation of ΔPITCH is $$|0-3C|/0.05859375=1024$$

When one operation cycle is given as 8 msec as described above, a portamento time is about 8.2 sec.

Unlike in the above example, when key depression speed is fastest, i.e., a PSF is given by 3F, and an OSC is 0 and an NSC is 1

$$\Delta PITCH = |0 - 1| \times 3F/1024$$
$$= 0.061523437$$

This is represented in binary notation as follows:

000000.0000111111

In this case, the number of accumulation times of ΔPITCH is $$|0-1|/0.061523437=16.25$$

As a result, the number of accumulation times is about 17, and a portamento time is about 136 msec (8 msec×16.25).

Similarly, assume that key depression speed is fastest (PSF=3F) and that an OSC is 0 and an NSC is 3C. In this case, $$\Delta PITCH = |0 - 3C| \times 3F/1024$$
$$= 3.69140625$$

In binary notation,

ΔPITCH=000011.1011000100

In this case, the number of times of accumulation of ΔPITCH is $$|0-3C|/3.69140625=16.25$$

The number of times is about 17, and thus a portamento time is about 136 msec in the same manner as described above.

In step S14, the small code ΔPITCHn representing the unit pitch interval of the portamento effect is obtained and stored in a corresponding area of register 8. Since the small code ΔPITCH depends on the key depression speed, it is readily understood that the portamento time is changed depending on the key touch response.

The operation advances from step S14 to step S15, and the content PITCH∇n stored in the corresponding area of register 9 for accumulating the small codes is cleared.

In step S16, the content (i.e., the key code OSCn) in the corresponding area of register 4 is fetched by CPU 2 and is supplied as the key code signal KCDn to converter 13. The corresponding frequency data fn is supplied to corresponding tone generator TGn in tone generators 14. In step S17, a key-on instruction signal is supplied to corresponding tone generator TGn through a control line (not shown), thereby starting tone generation.

In step S13, CPU 2 supplies data corresponding to 8 msec to a corresponding timer TIMERn of timers 12. In step S19, the corresponding timer TIMERn is started. The operation returns to step S2, and the operation described above is repeated.

Figure 4:
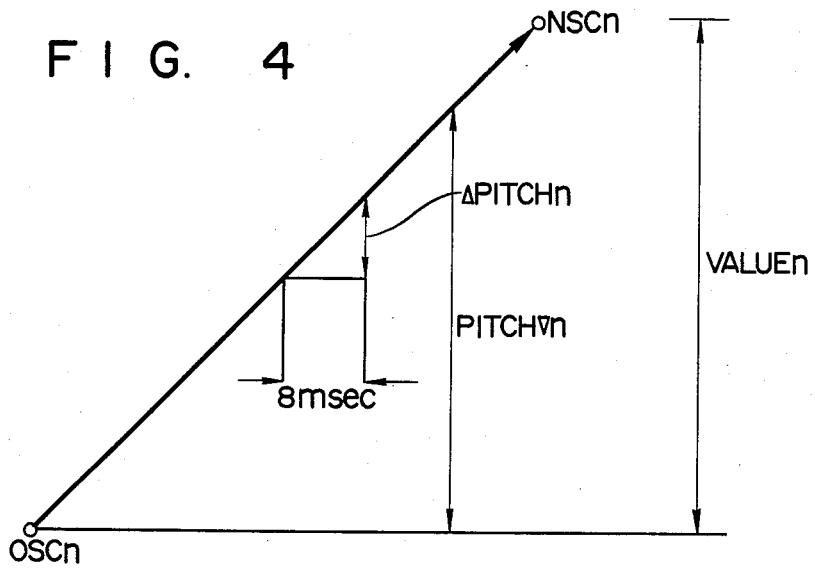
FIGS. 4 through 7 are diagrams for explaining operation states of the instrument of FIG. 1.

Tone generator TGn generates a musical tone signal with a pitch corresponding to the key code OSCn, as shown in FIG. 4. When the respective timers TIMERn count 8 msec, interrupt signals INTn are supplied to CPU 2. CPU 2 performs an operation in step S20 in FIG. 3B. The small code ΔPITCHn is read out from register 8 and is added to the data PITCH∇n stored in register 9. The sum is restored in the corresponding area of register 9. CPU 2 checks in step S21 whether or not the content of PITCH∇n stored in register 9 exceeds the content VALUEn stored in the corresponding area of register 6, i.e., whether or not the tone pitch being produced reaches the pitch of the depressed key. When CPU 2 determines PITCH∇n<VALUEn, the operation advances to step S22. The operation advances to step S23 or S24 in accordance with determination of the sign data SIGNn stored in register 7.

When the sign data is positive, the data OSCn stored in register 4 and PITCH∇n stored in register 9 are added together in step S23. The sum is supplied as the key code KCDn to converter 13, thereby increasing the pitch of a tone being produced.

However, when the sign data SIGNn is negative, the data PITCH∇n stored in register 9 is subtracted from the data OSCn stored in register 4. The resultant difference is supplied as the key code KCDn to converter 13 under the control of CPU 2, thereby decreasing the pitch of a tone being produced.

When interrupt processing is completed as described above, the operation returns to the normal processing. As shown in FIG. 4, the key code signal KCDn is incremented or decremented by the small code ΔPITCHn from the OSCn value to the NSCn value for every 8 msec. The tone is thus generated while its pitch is being changed at an interval of ΔPITCHn.

In the final stage of operation, when, in the interrupt processing, it is determined to be YES in step S21, the operation advances to step S25. When the accumulation result of the small codes exceeds the data VALUEn or |OSCn−NSCn|, the code VALUEn stored in register 6 is transferred to register 9 as PITCH∇n. In step S26, the operation of corresponding timer TIMERn is disabled. Therefore, a tone having a pitch corresponding to the sum of the VALUEn and the OSCn, i.e., a pitch corresponding to the key code NSCn of the newly depressed key is continuously generated until the depressed key is released. In this case, timer interrupt processing is not performed.

Figure 5:
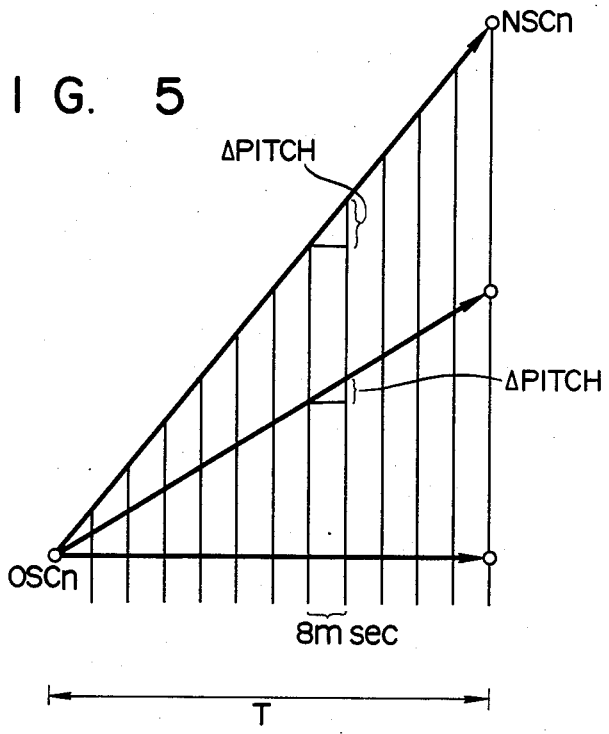

As is apparent from the above description, when a key depression speed is increased, a portamento time is shortened. However, as shown in FIG. 5, when key depression speeds are kept unchanged, portamento times are also kept unchanged for different VALUEn's.

Figure 6:
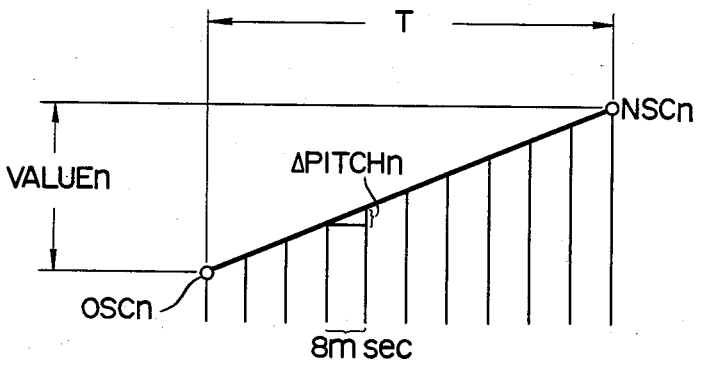
Figure 7:
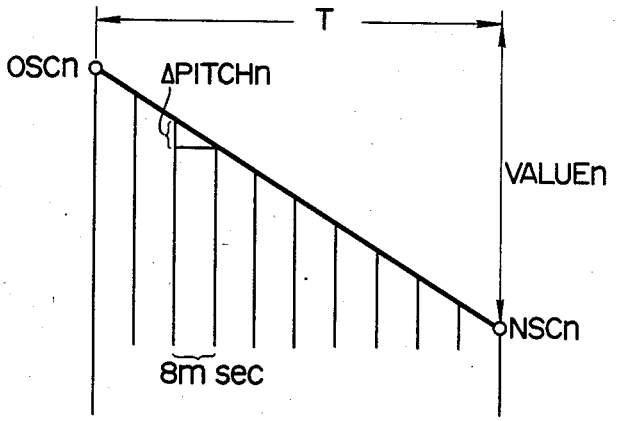

FIGS. 6 and 7 show portamento effects with increasing and decreasing tone pitches, respectively.

According to the embodiment described above, the portamento time can be changed in accordance with a change in touch response, thereby obtaining a variety of musical expressions.

In the above embodiment, the number of timers 12 is the same as that of the possible polyphonic tones. However, since each timer counts a fixed time, i.e., 8 msec, the timers can be replaced with a single timer. In this case, the key code updating processings for all tones being produced may be performed by an interrupt signal generated by the single timer 12.

A second embodiment of the present invention will be described hereinafter. A key code operation timing (the fixed time, i.e., 8 msec in the first embodiment) is changed in accordance with a difference between codes of old and new depressed keys so as to obtain an identical portamento time for the same key depression speed. The arrangement of the second embodiment is substantially the same as that of the first embodiment, and only differences therebetween will be described. The same reference numerals as in the second embodiment denote the same parts as in the first embodiment, and a detailed description thereof will be omitted.

Figure 8:
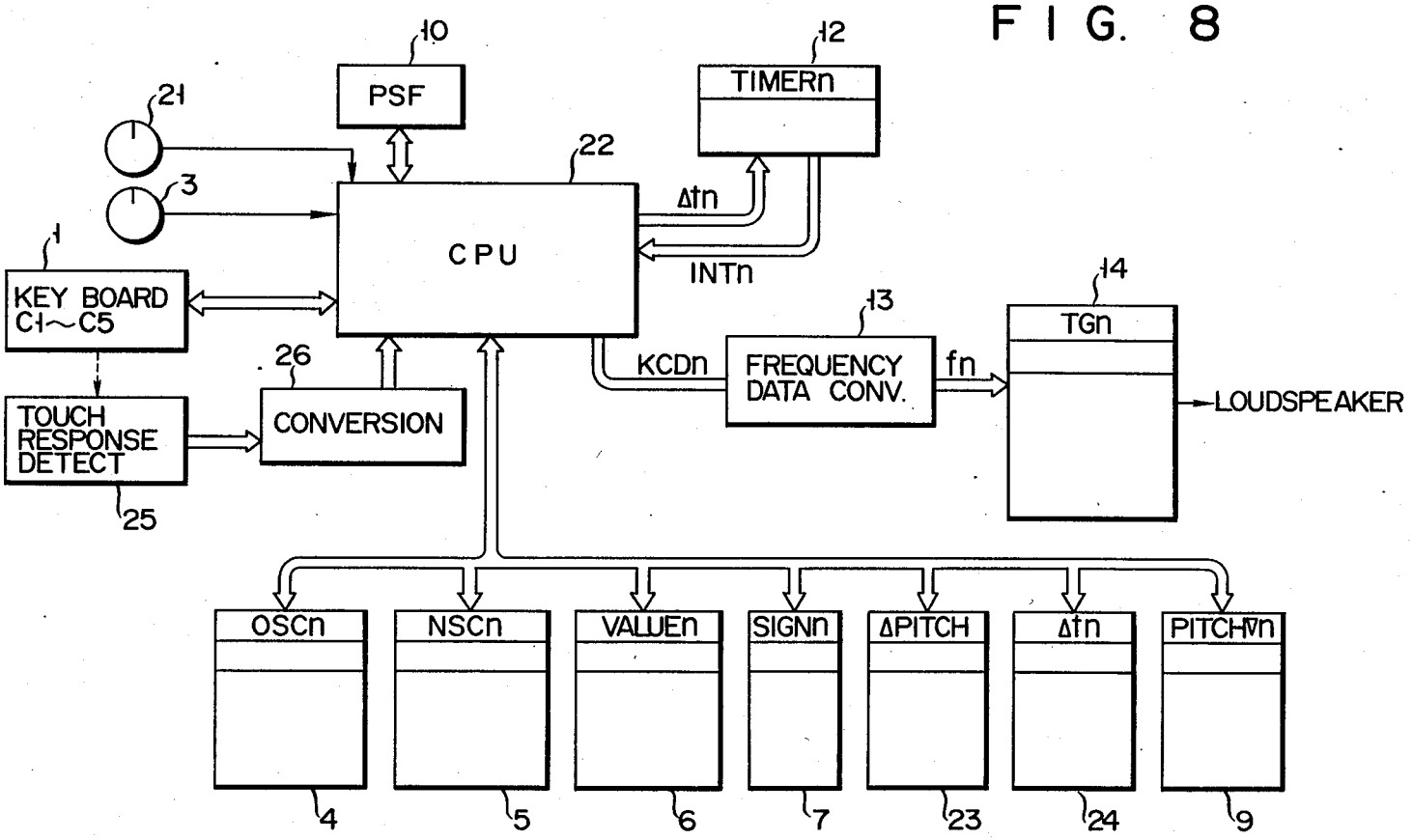
FIG. 8 is a block diagram of an electronic keyboard musical instrument with a portamento or glissando play function according to a second embodiment of the present invention.

In FIG. 8, potentiometer 3 determines a portamento time, i.e., a time for changing the old key code OSC to the new key code NSC. The corresponding time data is supplied as PSF to register 10. PSF is changed in accordance with a change in touch response in the same manner as in the first embodiment. Unlike in the first embodiment, PSF is small when a key depression speed is high, and PSF is large when a key depression speed is low.

A potentiometer 21 determines a key code variation width (in units of cents), i.e., ΔPITCH. A glissando effect can be easily realized with ΔPITCH set to 100 cents. The operation of potentiometer 21 can be detected by CPU 22, and detection data is stored as ΔPITCH in a register 23. Unlike in the first embodiment, the pitch variation width (ΔPITCH) for portamento is preset prior to musical performance.

A register 24 stores data Δtn for determining an operation cycle (timing) which is given by $$\Delta t = \mathrm{PSF}/|\mathrm{OSC}-\mathrm{NSC}|/\Delta\mathrm{PITCH}$$

In this embodiment, different data Δtn stored in register 24 are supplied to respective timers TIMERn to perform the interrupt control.

Figure 9A:
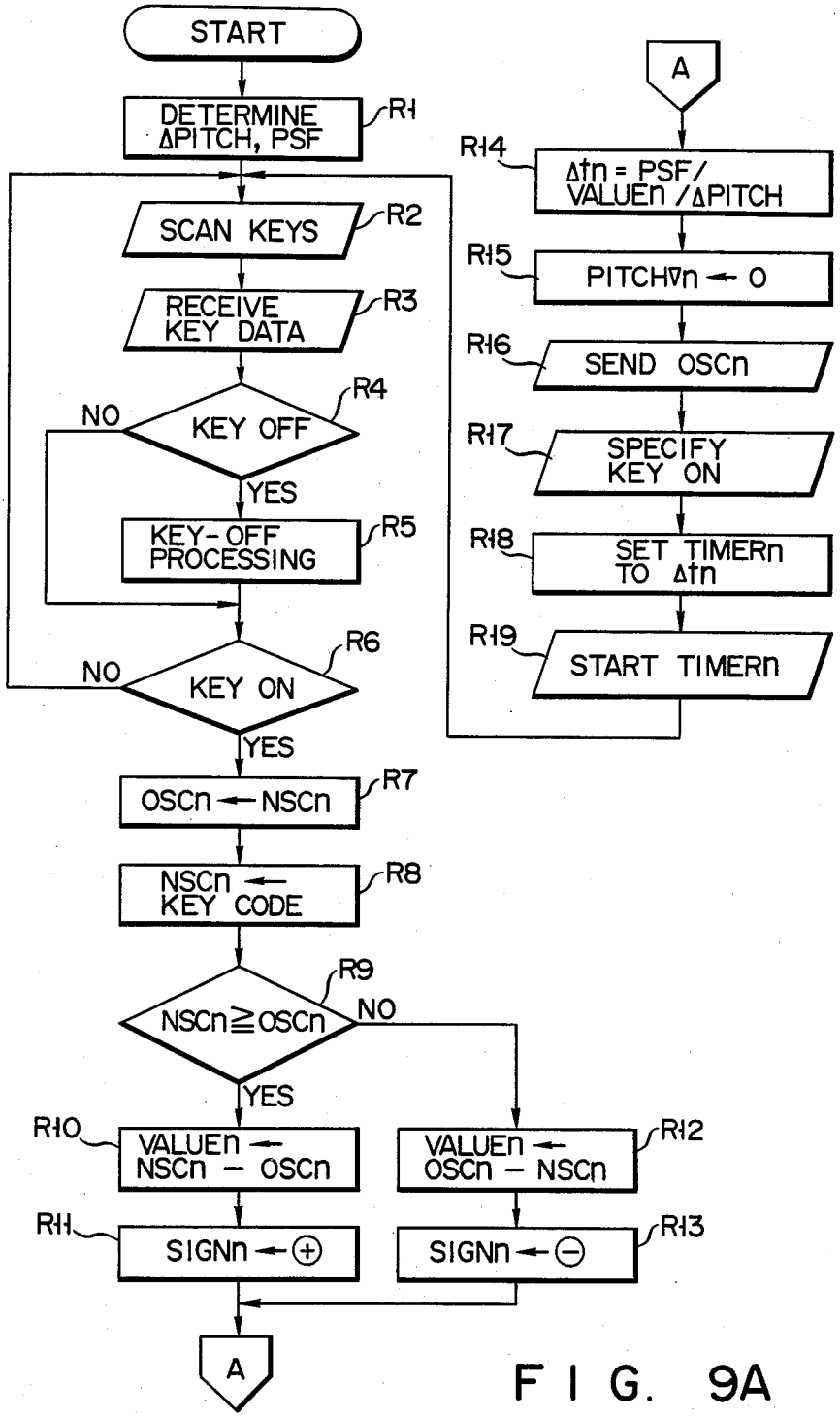
FIGS. 9A and 9B are a flow chart for explaining the operation of the instrument shown in FIG. 8.
Figure 9B:
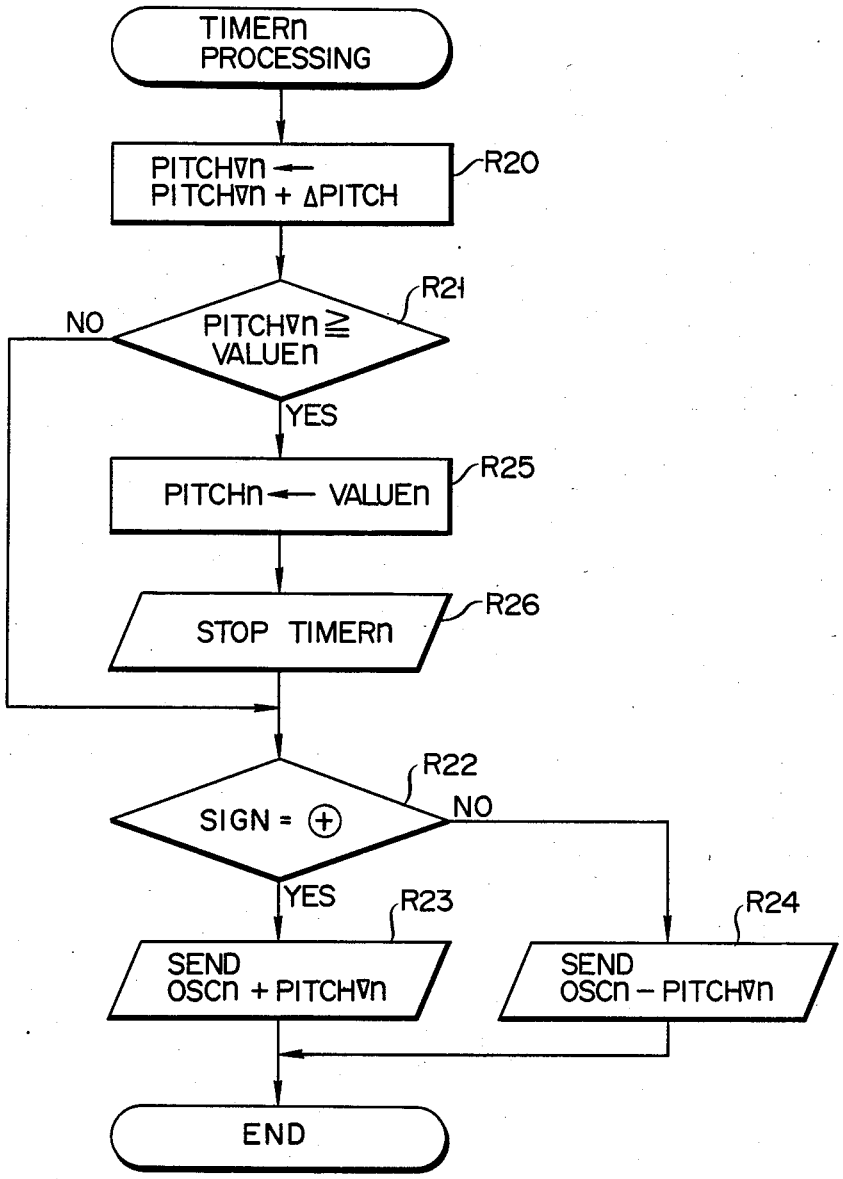

FIGS. 9A and 9B are flow charts showing operations carried out by CPU 22. in step R1 of FIG. 9A, portamento time data PSF is stored in a register 10 in response to touch response data or upon operation of potentiometer 3, and small code data ΔPITCH is stored in register 9 upon operation of potentiometer 21.

The operations in steps R2 through R13 are the same as those in steps S2 through S13 in the first embodiment shown in FIG. 3A.

In step R14 of FIG. 9B, CPU 22 calculates the data Δtn for determining the above-mentioned timing by using the data PSF stored in register 10, the data VALUEn stored in register 6, and the data ΔPITCH stored in register 23 as follows:

$$\Delta tn = \mathrm{PSF}/\mathrm{VALUE}n/\Delta\mathrm{PITCH}$$

Thus, the data Δtn changes in accordance with the data PSF representing the key depression speed and the data VALUEn. For example, when a key depression speed is low such that it is assumed that PSF is 8 or a portamento time is 8 sec, and the data ΔPITCH is 0.0625, the data OSC is 0 and the data NSC is 1

$$\Delta tn = 8/|1-0|/0.0625$$
$$= 0.5 \text{ sec}$$

Similarly, when the key depression speed is as slow as PSF=8, ΔPITCH is 0.0625, OSC is 0, and NSC is 3C, data Δtn is given by $$\Delta tn = 8/|3C-0|/0.0625$$

-continued $$= 8.3 \text{ msec}$$

In order to obtain an identical portamento time at the identical key depression speed, when an interval between old and new key notes is large the timer interrupt interval must be shortened. However, when the interval between the old and new notes is small, the timer interrupt interval must be prolonged.

When a key depression speed is increased so as to achieve a portamento time of about 1 sec., the data OSC is 0 and the data NSC is 3C, Δtn is given by $$\Delta tn = 2/|3C-0|/0.0625$$
$$= 1.0 \text{ msec}$$

In a case where an interval between the old and new key codes is kept unchanged, when a key depression speed is high, a timer interrupt interval must be shortened. When the depression speed is slow, on the other hand, the interrupt interval must be prolonged.

In this embodiment, it is possible to provide a glissando effect with a ΔPITCH of 1, i.e., an interval of 100 cents. For example, when PSF is 2, OSC is 0 and NSC is C $$\Delta tn = 2/|C-0|/1$$
$$= 166.6 \text{ msec}$$

Similarly, when ΔPITCH is 1, PSF is 2, OSC is 0 and NSC is 3C $$\Delta tn = 2/|3C-0|/1$$
$$= 33.3 \text{ msec}$$

Next, the operations in steps R16 to R19 are performed. These steps correspond to steps S16 to S19 of FIG. 3B, respectively. In step R18, the data Δtn preset in each timer TIMERn varies with the key depression speed and the interval between the old and new tone pitches.

When a time corresponding to the value Δtn preset in timer 12 has elapsed, an interrupt signal INTn is supplied to CPU 22.

As a result, CPU 22 performs operations in steps R20 to R26 in FIG. 9B. The operations in steps R20 to R26 in FIG. 9B are the same as those of steps S20 to S26 in FIG. 3B.

Figure 10:
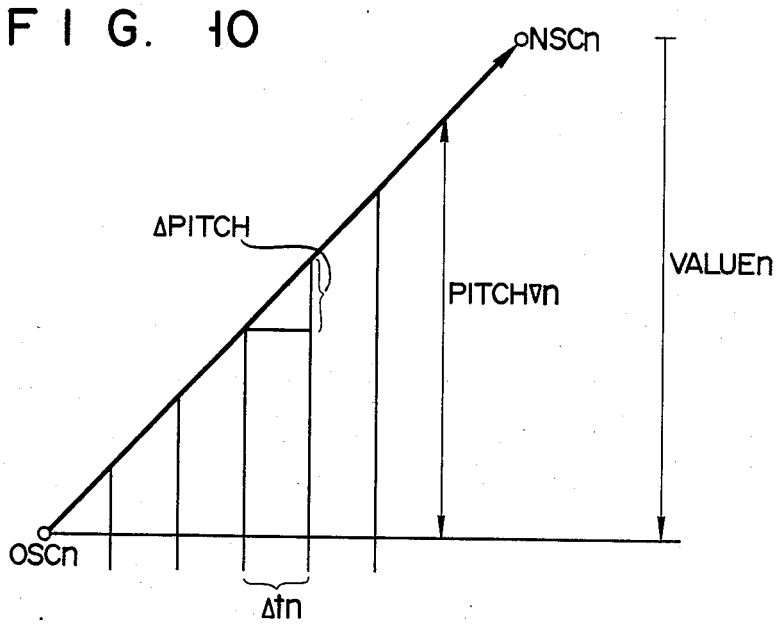
FIGS. 10 through 12 are diagrams for explaining operation states of the instrument of FIG. 8.

According to the second embodiment, tone pitch changes as shown in FIG. 10. The tone pitch successively varies from a value corresponding to the old key code OSCn to a value corresponding to the new key code NSCn in units of ΔPITCH. Therefore, Δtn for determining a timing of variation in tone pitch is changed depending on PSF corresponding to the key depression speed.

Figure 11:
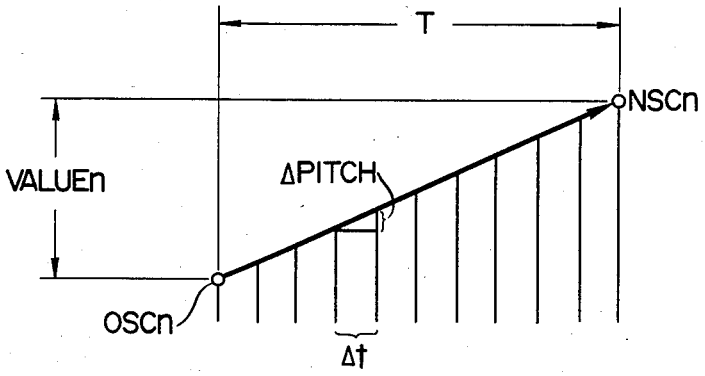
Figure 12:
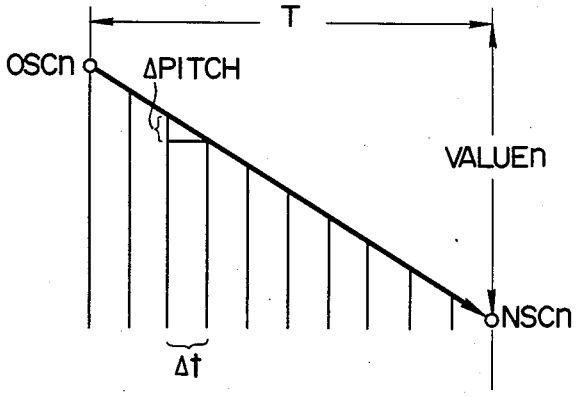

FIGS. 11 and 12 show portamento effects with increasing and decreasing tone pitches, respectively.

According to the second embodiment, the portamento time is changed in response to a change in touch response in the same manner as in the first embodiment, thus providing a good musical effect.

According to the second embodiment, the unit pitch change interval represented by the small code data ΔPITCH can be previously specified. Therefore, a glissando effect in units of semitones (100 cents) can be easily obtained.

In the first and second embodiments described above, the portamento or glissando time is changed in accordance with the key depression speed. However, the present invention is not limited to such a technique. The portamento or glissando time can be changed in accordance with a key depression pressure.

What is claimed is:

1. An electronic keyboard musical instrument with a portamento or glissando play function comprising:

keyboard means having a plurality of keys to which musical notes are assigned;

touch response detecting means coupled to said keyboard means for detecting a touch response of a key depressed on said keyboard means;

key code signal generating means coupled to said keyboard means for generating a key code signal corresponding to the note of a key depressed on said keyboard means; and musical tone signal generating means coupled to said key code signal generating means for generating a musical tone signal with a pitch corresponding to the key code signal;

said key code signal generating means including play effect providing means for providing a portamento or glissando effect to the musical tone signal generated by said musical tone signal generating means, said play effect providing means being responsive to said touch response detecting means to change a portamento or glissando time in accordance with the detected touch response of the key depressed on said keyboard, wherein said key code signal generating means comprises microprocessor means, and register means and timer means coupled to said microprocessor means, data BIAS representing a minimum pitch change width in portamento play being preset in a first region of said register means, and said microprocessor means being programmed to perform an operation comprising the steps of:

storing touch response data PSF of a key depressed on said keyboard means in a second region of said register means, the touch response data PSF representing a portamento speed factor;

storing a previous key code OSC of a previously depressed key and a current key code NSC of a currently depressed key in third and fourth regions of said register means, respectively;

calculating a difference between the previous key code OSC and the current key code NSC and storing an absolute value data VALUE of the difference and sign data SIGN representing a sign of the difference in fifth and sixth regions of said register means, respectively;

calculating PSF×VALUE/BIAS representing a small code ΔPITCH and storing it in a seventh region of said register means;

supplying the previous key code signal to said musical tone generating means to generate a musical tone signal corresponding to a note of the previously depressed key;

starting timer means to generate an interrupt signal every time a predetermined period of time has elapsed;

accumulating the small code ΔPITCH in an eighth region of said register means every time the interrupt signal is generated by said timer;

combining an accumulated value PITCHΔ of the small code ΔPITCH with the key code signal generating means every time the interrupt signal is generated; and comparing the accumulated value PITCHΔ with the data VALUE to stop said timer means when the accumulated value exceeds the data VALUE.

2. An instrument according to claim 1, wherein said play effect providing means is arranged to change stepwise with time the key code signal supplied to said musical tone signal generating means in response to said touch response detecting means from a key code of a previously depressed key to a key code of a currently depressed key.

3. An instrument according to claim 2, wherein a time interval in which the key code signal is changed is constant, and wherein said play effect providing means is arranged to change a magnitude of pitch step width in response to said touch response detecting means.

4. An instrument according to claim 2, wherein a magnitude of pitch step width is constant, and wherein said play effect providing means is arranged to change a time interval in which the key code signal is changed in response to said touch response detecting means.

5. An instrument according to claim 1, wherein said touch response detecting means is arranged to detect a key depression speed.

6. An instrument according to claim 1, wherein when the data SIGN of the difference between the previous and current key codes represents a positive sign, the accumulated value PITCHΔ of the small code is added to the key code signal being supplied to said musical tone signal generating means in the combining step.

7. An instrument according to claim 1, wherein when the data SIGN of the difference between the previous and current key codes represents a negative sign, the accumulated value PITCHΔ of the small code is subtracted from the key code signal being supplied to said musical tone signal generating means in the combining step.

8. An electronic keyboard musical instrument with a portamento or glissando play function comprising:

keyboard means having a plurality of keys to which musical notes are assigned;

touch response detecting means coupled to said keyboard means for detecting a touch response of a key depressed on said keyboard means;

key code signal generating means coupled to said keyboard means for generating a key code signal corresponding to the note of a key depressed on said keyboard means; and musical tone signal generating means coupled to said key code signal generating means for generating a musical tone signal with a pitch corresponding to the key code signal;

said key code signal generating means including play effect providing means for providing a portamento or glissando effect to the musical tone signal generated by said musical tone signal generating means, said play effect providing means being responsive to said touch response detecting means to change a portamento or glissando time in accordance with the detected touch response of the key depressed on said keyboard, wherein said key code signal generating means comprises microprocessor means, register means and timer means coupled to said microprocessor means, and minimum pitch interval change width setting means for setting a minimum pitch interval change width in portamento play, and wherein data ΔPITCH representing a small code is preset by said minimum pitch interval change width setting means in a first region of said register means, and said microprocessor means being programmed to perform an operation comprising the steps of:

storing touch response data PSF of a key depressed on said keyboard means in a second region of said register means, the touch response data PSF representing a portamento speed factor;

storing a previous key code OSC of a previously depressed key and a current key code NSC of a currently depressed key in third and fourth regions of said register means, respectively;

calculating a difference between the previous key code OSC and the current key code NSC and storing an absolute value data VALUE of the difference and sign data SIGN representing a sign of the difference in fifth and sixth regions of said register means, respectively;

calculating PSF×VALUE/ΔPITCH representing operation time data Δt and storing it in a seventh region of said register means;

supplying the previous key code signal to said musical tone generating means to generate a musical tone signal corresponding to a note of the previously depressed key;

setting the operation time data Δt in said timer means;

starting said timer means to generate an interrupt signal every time the operation time Δt has elapsed;

accumulating the small code ΔPITCH in an eighth region of said register means every time the interrupt signal is generated by said timer means;

combining an accumulated value PITCHΔ of the small code ΔPITCH with the key code signal being supplied to said musical tone signal generating means every time the interrupt signal is generated; and comparing the accumulated value PITCHΔ with the data VALUE to stop said timer means when the accumulated value exceeds the data VALUE.

9. An instrument according to claim 8, wherein when the data SIGN of the difference between the previous and current key codes represents a positive sign, the accumulated value PITCHΔ of the small code is added to the key code signal being supplied to said musical tone signal generating means in the combining step.

10. An instrument according to claim 8, wherein when the data SIGN of the difference between the previous and current key codes represents a negative sign, the accumulated value PITCHΔ of the small code is subtracted from the key code signal being supplied to said musical tone signal generating means in the combining step.

11. An electronic keyboard musical instrument with a portamento or glissando play function comprising:

keyboard means having a plurality of keys to which musical notes are assigned;

touch response detecting means coupled to said keyboard means for detecting a touch response of a key depressed on said keyboard means;

key code signal generating means coupled to said keyboard means for generating a key code signal corresponding to the note of a key depressed on said keyboard means; and musical tone signal generating means coupled to said key code signal generating means for generating a musical tone signal with a pitch corresponding to the key code signal;

said key code signal generating means including play effect providing means for providing a portamento or glissando effect to the musical tone signal generated by said musical tone signal generating means, said play effect providing means being responsive to said touch response detecting means to change a portamento or glissando time in accordance with the detected touch response of the key depressed on said keyboard, wherein said play effect providing means is arranged to change stepwise with time the key code signal supplied to said musical tone signal generating means in response to said touch response detecting means from a key code of a previously depressed key to a key code of a currently depressed key.

12. An instrument according to claim 11, wherein a time interval in which the key code signal is changed is constant, and wherein said play effect providing means is arranged to change a magnitude of pitch step width in response to said touch response detecting means.

13. An instrument according to claim 11, wherein a magnitude of pitch step width is constant, and wherein said play effect providing means is arranged to change a time interval in which the key code signal is changed in response to said touch response detecting means.

14. An instrument according to claim 13, wherein said touch response detecting means is arranged to detect a key depression speed.

15. An instrument according to claim 12, wherein said touch response detecting means is arranged to detect a key depression speed.

16. An electronic keyboard musical instrument with a portamento or glissando play function comprising:

keyboard means having a plurality of keys to which musical notes are assigned;

touch response detecting means coupled to said keyboard means for detecting a key depression speed of a key depressed on said keyboard means;

key code signal generating means coupled to said keyboard means for generating a key code signal corresponding to the note of a key depressed on said keyboard means; and musical tone signal generating means coupled to said key code signal generating means for generating a musical tone signal with a pitch corresponding to the key code signal;

said key code signal generating means including play effect providing means for providing a portamento or glissando effect to the musical tone signal generated by said musical tone signal generating means, said play effect providing means being responsive to said touch response detecting means to change a portamento or glissando time in accordance with the detected key depression speed of the key depressed on said keyboard.

* * * * *